US005221139A

United States Patent [19]

Belfer

[11] Patent Number: 5,221,139

[45] Date of Patent: Jun. 22, 1993

[54] FLUORESCENT LIGHTING FIXTURE

[75] Inventor: Bruce D. Belfer, Ocean, N.J.

[73] Assignee: Lighting World Inc., Ocean, N.J.

[21] Appl. No.: 834,649

[22] Filed: Feb. 12, 1992

[51] Int. Cl.[5] ..... F21S 3/02

[52] U.S. Cl. ..... 362/225; 362/216; 362/219; 362/382

[58] Field of Search ..... 362/216, 217, 219, 249, 362/260, 382, 225

[56] References Cited

U.S. PATENT DOCUMENTS 2,298,824 10/1942 Darley ..... 362/219

5,060,125 10/1991 Cowie et al. ..... 362/217

*Primary Examiner*—Ira S. Lazarus
*Assistant Examiner*—Y. Quach
*Attorney, Agent, or Firm*—Ezra Sutton

[57] ABSTRACT

A fluorescent lighting fixture provides shadowless linear lighting. A support member is provided for supporting a plurality of lamp supports. The lamp supports support the fluorescent lamps on an angle, so that the non-socket end of the fluorescent lamp overlaps the socket of an adjacent lamp so as to provide shadowless linear lighting.

4 Claims, 3 Drawing Sheets

FLUORESCENT LIGHTING FIXTURE

FIELD OF THE INVENTION

The present invention relates to a fluorescent lighting fixture that provides shadowless and continuous linear lighting by mounting a lamp at an angle to overlap the socket of an adjacent lamp.

BACKGROUND OF THE INVENTION

In present linear lighting, the fluorescent lamps are arranged in a straight line, all on the same level. However, the socket of each fluorescent lamp causes a shadow and non-uniform lighting.

It is an object of the present invention to provide a fluorescent lighting fixture that provides shadowless linear lighting and high lumen output per linear foot.

SUMMARY OF THE INVENTION

In accordance with the principles of the present invention, there is provided a fluorescent lighting fixture having a support member and an upper surface, a plurality of lamp supports mounted on the upper surface of the support member for engaging and supporting the fluorescent lamps adjacent their socket ends, with the spacing between the lamp supports being less than the length of one of the fluorescent lamps, so that the non-socket end of one fluorescent lamp overlaps the socket end of an adjacent lamp so as to provide shadowless and continuous linear lighting.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
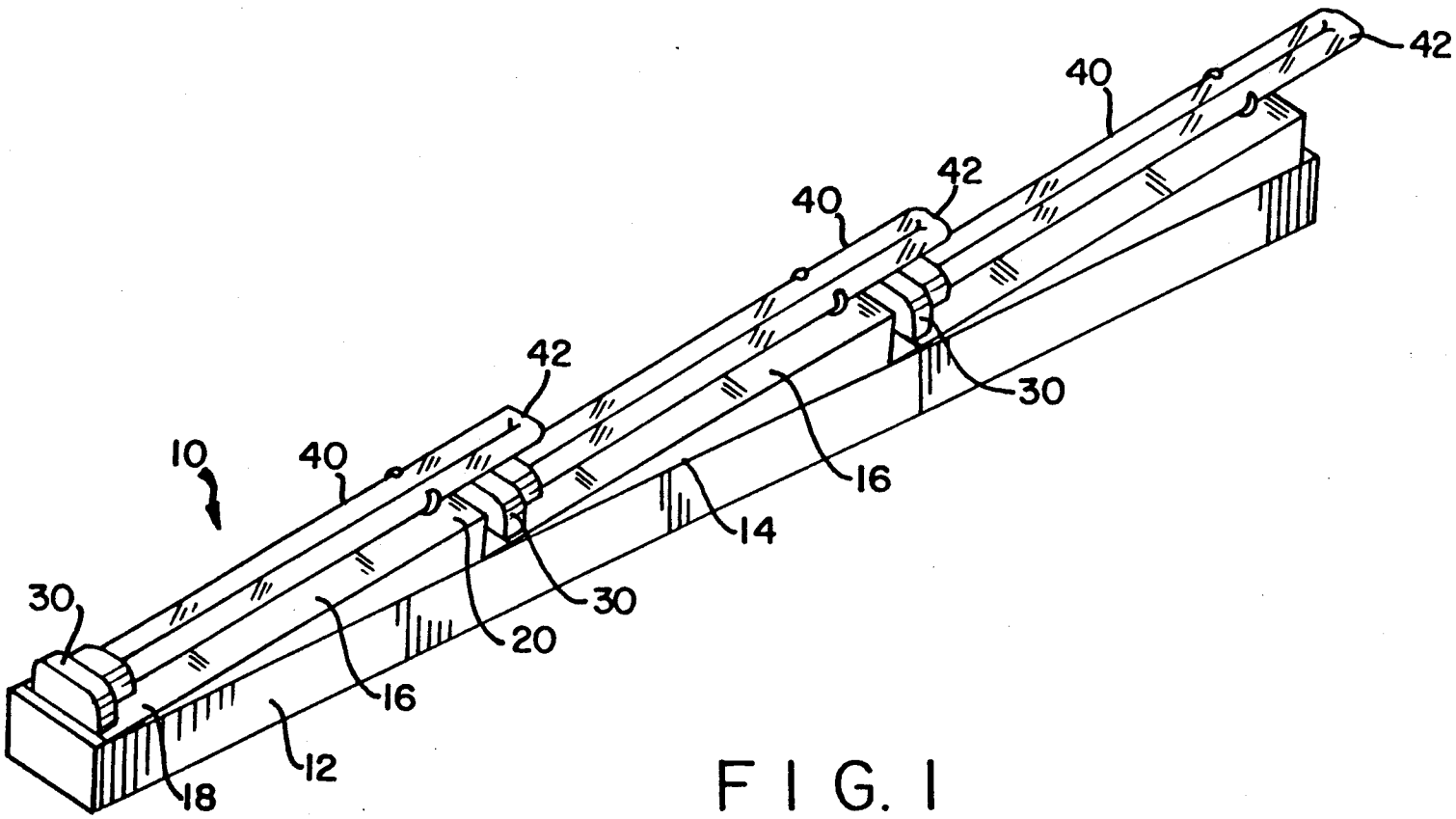
FIG. 1 is a perspective view of a lighting fixture embodying the present invention.
Figure 2:
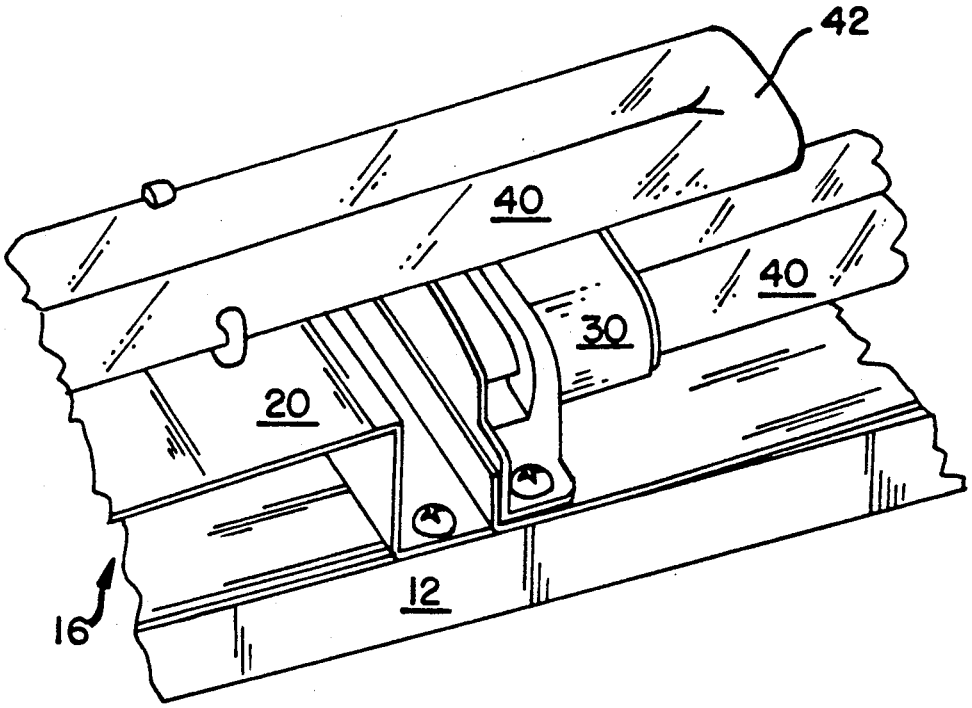
FIG. 2 is a detailed view of the end of one lamp overlapping the socket of an adjacent lamp.

Referring to FIG. 1, there is shown the lighting fixture 10 having a support member 12 and an upper surface 14. A plurality of ramps 16 are mounted in a straight line on upper surface 14 of support member 12.

Each of ramps 16 has a lower end 18 and an upper end 20, so that the lower end 18 of one ramp 16 is adjacent to the upper end 20 of an adjacent ramp 16. The ramps may be formed of extruded aluminum and are screwed into the upper surface 14 of the support member 12.

Mounted on or adjacent to the lower end 18 of each ramp 16 is a socket 30 for receiving a fluorescent lamp 40. The socket is screwed into the ramp. Preferably, lift-up sockets are employed so that it is easy to remove the lamps. The length of each ramp 16 is less than the length of each fluorescent lamp 40. In this manner, the non-socket end 42 of fluorescent lamp 40 overlaps the socket 30 of an adjacent lamp 40 mounted on the lower end of an adjacent ramp 16 so as provide shadowless linear lighting.

Figure 3:
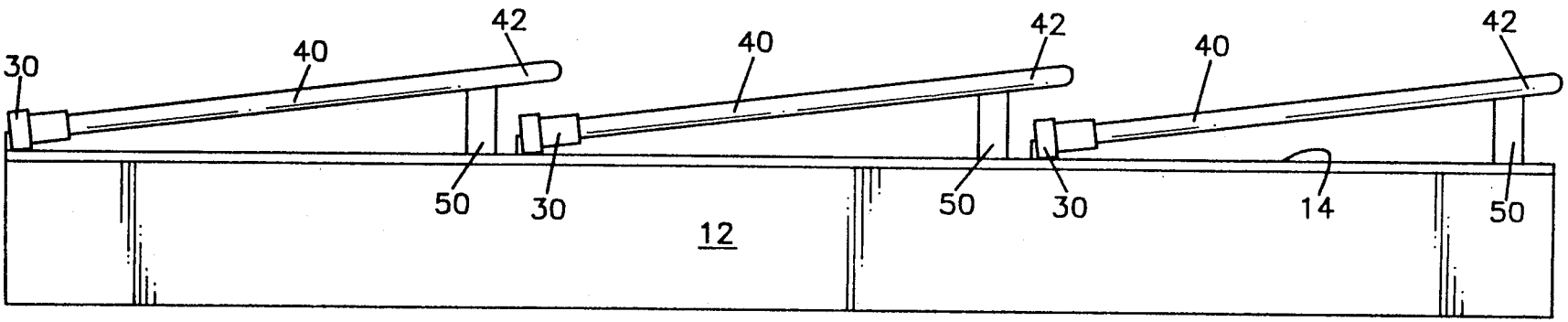
FIG. 3 is a side elevational view of a second embodiment of a lighting fixture employing supporting posts.

Referring to FIG. 3, there is shown another embodiment of the invention, wherein the lamp supports are posts 50 instead of ramps 16. Posts 50 may be of a height of 3.5 inches or 5 inches, depending on the particular installation and desired effect.

The spacing between each of the sockets 30 and posts 50 is less than the length of one of the lamps 40, so that the non-socket end 42 of one of the lamps 40 mounted on one of the posts 50 overlaps the socket 30 of an adjacent lamp 40 so as to provide shadowless and continuous linear lighting.

Figure 4:
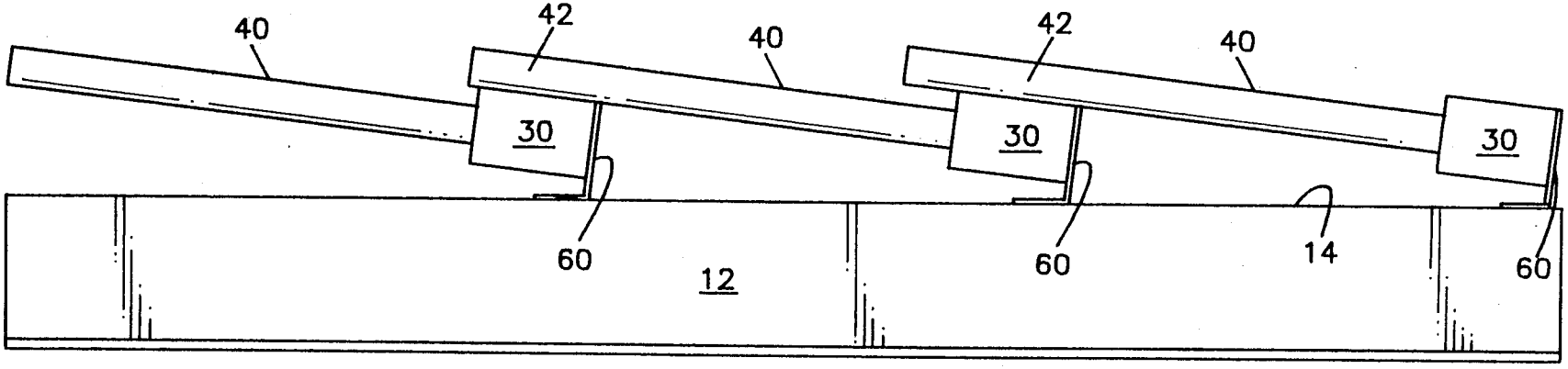
FIG. 4 is a side elevational view of a third embodiment employing supporting brackets.

Referring to FIG. 4, there is shown another embodiment of the invention, wherein the lamp supports are angled brackets 60 instead of ramps 16. The spacing between each of the sockets 30 is less than the length of one of the lamps 40, so that the non-socket end 42 of one of the lamps 40 overlaps the socket 30 of an adjacent lamp 40 so as to provide shadowless and continuous linear lighting.

As a result of the present invention, a lighting fixture has been provided which overcomes the drawbacks of prior fixtures and provides shadowless linear lighting.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lighting fixture for fluorescent lighting, comprising:

a) a support member having an upper surface;

b) a plurality of ramps mounted on the upper surface of said support member;

c) each of said plurality of ramps having a lower end and a higher end, with the lower end of one ramp being adjacent to the higher end of an adjacent ramp; and d) a socket for receiving a fluorescent lamp mounted adjacent to the lower end of each ramp, with the length of each ramp being less than the length of the fluorescent lamp and socket, so that the non-socket end of one fluorescent lamp mounted on the higher end of one ramp overlaps the socket end of an adjacent fluorescent lamp mounted on the lower end of an adjacent ramp so as to provide shadowless and continuous linear lighting.

2. A lighting fixture in accordance with claim 1, wherein said plurality of ramps are mounted in a straight line and one of said sockets are mounted on the lower end of each of said plurality of ramps.

3. A lighting fixture for mounting fluorescent lamps, comprising:

a) a support member having an upper surface;

b) a plurality of lamp supports mounted on the upper surface of said support member for engaging and supporting said fluorescent lamps adjacent their non-socket ends;

c) said plurality of lamp supports being equally spaced apart in a straight line;

d) a plurality of sockets corresponding to said plurality of lamp supports for receiving said fluorescent lamps mounted on the upper surface of said support member and being equally spaced apart in a straight line each of said plurality of sockets being adjacent the socket end of one of said fluorescent lamps; and e) the spacing between each of said plurality of sockets and each of said corresponding lamp supports being less than the length of one of said fluorescent lamps, so that the non-socket end of one fluorescent plurality of lamps mounted on one of said lamp supports overlaps the socket end of an adjacent fluorescent lamp so as to provide shadowless and continuous linear lighting.

4. A lighting fixture in accordance with claim 3, wherein said plurality lamp supports are posts mounted on the upper surface of said support member.

* * * * *

UNITED STATES PATENT AND TRADEMARK OFFICE

CERTIFICATE OF CORRECTION

PATENT NO. : 5,221,139

DATED : June 22, 1993

INVENTOR(S) : Bruce D. Belfer

It is certified that error appears in the above-indentified patent and that said Letters Patent is hereby corrected as shown below:

Claim 3, Column 2, line 68, after "line", insert --and--.

Claim 3, Column 2, line 7, delete "plurality of lamps", and insert --lamp--.

Claim 3, Column 3, line 7, after "said", insert --plurality of--.

Claim 4, Column 4, line 5, after "plurality", insert --of--.

Signed and Sealed this

Twenty-ninth Day of March, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,221,139

DATED : June 22, 1993

INVENTOR(S) : Bruce D. Belfer

It is certified that error appears in the above-indentified patent and that said Letters Patent is hereby corrected as shown below:

Claim 3, Column 2, line 68, after "line", insert --and--.
Claim 3, Column 3, line 7, delete "plurality of lamps", and insert --lamp--.
Claim 3, Column 3, line 7, after "said", insert --plurality of--.
Claim 4, Column 4, line 5, after "plurality", insert --of--.

This certificate supersedes Certificate of Correction issued March 29, 1994

Signed and Sealed this

Twenty-first Day of June, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,221,139

DATED : June 22, 1993

INVENTOR(S) : Bruce D. Belfer

It is certified that error appears in the above-indentified patent and that said Letters Patent is hereby corrected as shown below:

Claim 3, Column 2, line 68, after "line", insert —and—.
Claim 3, Column 3, line 7, delete "plurality of lamps", and insert —lamp—.

Claim 4, Column 4, line 5, after "plurality", insert —of—.

This certificate supersedes Certificate of Correction issued June 21, 1994

Signed and Sealed this

Twenty-third Day of January, 1996

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,221,139

DATED : June 22, 1993

INVENTOR(S) : Bruce D. Belfer

It is certified that error appears in the above-identified patent and that said Letters Patent is hereby corrected as shown below:

Claim 3, column 2, line 68, after "line", insert --and--.

Claim 3, column 3, line 7, delete "plurality of lamps", and insert -- lamp--.

Claim 3, column 3, line 7, after "said", insert --plurality of--.

Claim 4, column 4, line 5, after "plurality", insert --of--.

This Certificate of Correction supersedes Certificates of Correction issued on March 29, 1994, June 21, 1994 and January 23, 1996.

Signed and Sealed this

Twelfth Day of March, 1996

*Attest:*

*Attesting Officer*

Bruce Lehman

BRUCE LEHMAN

*Commissioner of Patents and Trademarks*